United States Patent [19]

Faust

[11] 4,009,495

[45] Mar. 1, 1977

[54] VENTILATED BRIEFS

[75] Inventor: Martin H. Faust, Wyomissing Hills, Pa.

[73] Assignee: Penn-Dale Knitting Mills, Inc., Sinking Spring, Pa.

[22] Filed: Apr. 25, 1975

[21] Appl. No.: 571,555

[52] U.S. Cl. ..... 2/406

[51] Int. Cl.[2] ..... A41B 9/04

[58] Field of Search ..... 2/224 A, 224 R, 225, 2/226, 78 B, 78 R, 78 C, DIG. 1; 66/177, 176, 202

[56] References Cited

UNITED STATES PATENTS

| | | | |
|---|---|---|---|
| 1,277,074 | 8/1918 | Hitzeman | 2/78 C |
| 2,190,425 | 2/1940 | Hurd | 2/78 B |
| 3,132,497 | 5/1964 | Garrou | 66/176 X |
| 3,208,242 | 9/1965 | Fors | 66/177 |
| 3,566,624 | 3/1971 | Burleson | 2/224 R |
| 3,815,156 | 6/1974 | Gaither | 2/224 R |
| 3,909,851 | 10/1975 | Garrou et al. | 2/224 R |
| 3,924,423 | 12/1975 | Lonati | 66/177 X |

*Primary Examiner*—H. Hampton Hunter
*Attorney, Agent, or Firm*—William J. Ruano

[57] ABSTRACT

A brief of stretch fabric of nylon or similar synthetic threads but having a crotch portion and side portions integrally knitted of cotton thread having considerably greater size openings or mesh in the knit for ventilation purposes.

1 Claim, 1 Drawing Figure

VENTILATED BRIEFS

Figure 1:
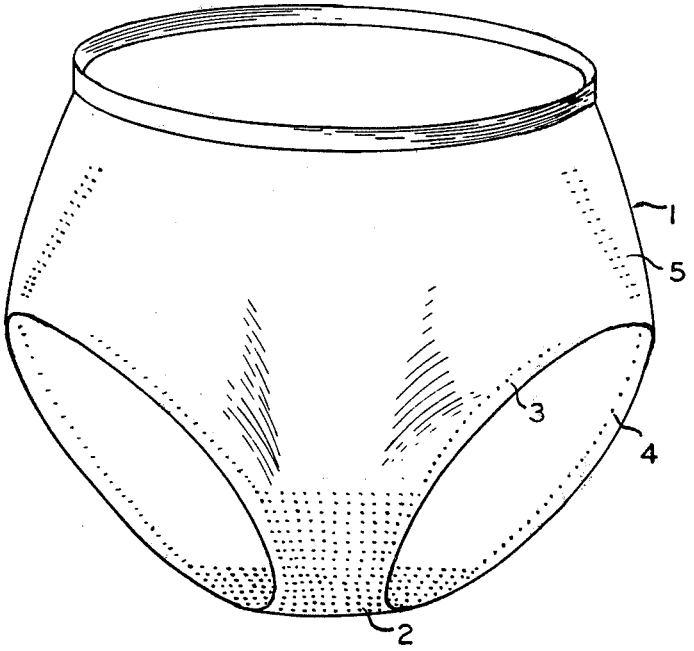

This invention relates to a brief, particularly a woman's brief or panty, although it is useful even in men's briefs.

An outstanding disadvantage of presently used women's briefs or panties is that they are generally knit from stretch yarns of plastic material, such as nylon, orlon, etc. and such yarns often include rubber to give even greater stretch characteristics, as a consequence of which, the knitted material becomes "clammy", that is, does not "breathe", so to speak, and causes perspiration in the crotch portion of the wearer's body, which is a source of irritation and discomfort.

An object of my invention is to provide a novel woman's brief or panty which is devoid of the abovenamed disadvantages and which has an integrally knit crotch portion of different thread, namely cotton, with considerably larger mesh openings than the remainder of the garment so as to provide a high degree of ventilation and comfort in the crotch portion of the garment, yet which brief or panty has stretch characteristics.

A more specific object of the present invention is to provide a novel woman's brief or panty which is knitted of stretch nylon or similar synthetic stretch material in the basic body portion but which is integrally knitted with cotton at the crotch portion and possibly the side portions to provide a high degree of ventilation and comfort, yet retaining the general stretch characteristics of the garment as a whole.

Other objects and advantages will become more apparent from a study of the following description taken with the accompanying drawing wherein:

FIG. 1 is a front view showing a woman's brief having an integrally knit ventilating crotch portion embodying the principles of the present invention.

Referring more particularly to FIG. 1 of the drawing, numeral 1 deontes a basic woman's stretch panty made of stretchable nylon, orlon or similar synthetic material to provide two way stretch in the basic garment. Numeral 2 denotes a crotch portion which is integrally knit during the knitting of basic garment 1 in the manner known in the art as taught by applicant's prior U.S. Pat. No. 3,178,911, dated Apr. 20, 1965, entitled "Foundation Garment", — also a patent issued to Garrouet al. U.S. Pat. No. 2,706,389 dated Apr. 19, 1955.

The crotch portion 2 is integrally knit of cotton thread because of the comfort and breathability of cotton, but, more important, the openings or mesh in the cotton knit are considerably greater than those of the stretch yarn forming the body portion 1 so as to provide a very high degree of ventilation to genital parts of the body that tend to perspire. It will be noted that the open knit of the crotch portion 2 extends upwardly on both the front and rear portions, as indicated in the dotted lines. It will also be noted that the open net cotton may be entended also along leg surrounding edge portions 3 and 4 as well, and along the sides 5. Of course either or both of such additional larger mesh cotton areas may be omitted, if desired.

While the large mesh or opening knit cotton of crotch portion 2 will have no appreciable stretchability, this is not a serious disadvantage since the area of the large mesh cotton crotch is only a small portion of the total area of the panty.

However, even the large mesh knit cotton forming the crotch portion 2 may be knit in the manner described in a co-pending application of Alan Faust, filed and assigned to the present assignee. This imparts substantial stretchability even to the knit crotch portion.

Thus it will be seen that I have provided a novel and highly useful panty or brief which, while described as useful for women is also useful for men's jockey type briefs; also I have provided a panty or brief of knitted stretch synthetic material, such as nylon, except for the crotch portion which is knitted integrally with cotton thread to form a crotch portion with considerably larger mesh than the remainder of the brief or panty, that is, having a mesh opening of 10 times more than the mesh openings in the knit plastic body portion. This will give a high degree of ventilation as the result of the large mesh of the crotch portion aided by the employment of cotton as the thread material, instead of stretch plastic material; also I have provided that even the cotton knitted crotch portion of large mesh may likewise be of stretch cotton material when the cotton is knitted in the manner taught in the aforesaid co-pending application of Alan Faust showing concentrically arranged spools of thread of stretch yarn and cotton, the core being of stretch yarn around which there is helically wound from the upper spool, a cotton thread, then the composite thread is lead directly into a circular knitting machine.

While I have illustrated and described a single specific embodiment of my invention, it will be understood that this is by way of illustration only and that various changes and modifications may be contemplated in my invention and within the scope of the following claims.

I claim:

1. A panty knit of synthetic plastic threads throughout the entire body portion with the exception of a crotch and leg surrounding portions which crotch and leg surrounding portions are integrally knit thereto by cotton thread formed of a core of stretch yarn around which cotton thread is helically wound which forms courses of considerably larger sized mesh openings extending across the entire width of said crotch portion and being devoid of seams throughout the entire area of said crotch portion so as to provide a high degree of ventilation and perspiration absorption and a further exception of integrally knit cotton thread portions of considerably larger sized mesh openings being provided also along the sides of the panty.

* * * * *